US008764544B2

(12) United States Patent
Daniels

(10) Patent No.: US 8,764,544 B2
(45) Date of Patent: Jul. 1, 2014

(54) GAMING SYSTEM AND METHOD PROVIDING A KENO GAME INCLUDING AN ADDITIONAL NUMBER TRIGGERING EVENT THAT CAUSES AT LEAST ONE ADDITIONAL NUMBER TO BE ADDED TO A SELECTED NUMBER SET TO FORM A MODIFIED NUMBER SET

(75) Inventor: David W. Daniels, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/481,475

(22) Filed: May 25, 2012

(65) Prior Publication Data

US 2013/0316782 A1 Nov. 28, 2013

(51) Int. Cl.
*A63F 3/06* (2006.01)

(52) U.S. Cl.
USPC ..... 463/19

(58) Field of Classification Search
USPC ..... 463/16–20, 25–30
See application file for complete search history.

(56) References Cited

U.S. PATENT DOCUMENTS

| | | | |
|---|---|---|---|
| 2,137,392 | A | 11/1938 | Cobb |
| 4,033,588 | A | 7/1977 | Watts |
| 4,611,811 | A | 9/1986 | Haase |
| 4,661,906 | A | 4/1987 | DiFrancesco et al. |
| 4,676,509 | A | 6/1987 | Bishop |
| 4,711,454 | A | 12/1987 | Small |
| 4,747,600 | A | 5/1988 | Richardson |
| 4,775,155 | A | 10/1988 | Lees |
| 4,798,387 | A | 1/1989 | Richardson |
| 4,856,787 | A | 8/1989 | Itkis |
| 4,875,686 | A | 10/1989 | Timms |
| 4,878,787 | A | 11/1989 | Hunt |
| 5,005,840 | A | 4/1991 | Schwartz |
| 5,043,887 | A | 8/1991 | Richardson |
| 5,046,737 | A | 9/1991 | Fienberg |
| 5,072,381 | A | 12/1991 | Richardson et al. |
| 5,100,139 | A | 3/1992 | Di Bella |
| 5,116,049 | A | 5/1992 | Sludikoff et al. |
| 5,158,293 | A | 10/1992 | Mullins |
| 5,242,163 | A | 9/1993 | Fulton |
| 5,273,281 | A | 12/1993 | Lovell |
| 5,351,970 | A | 10/1994 | Fioretti |

(Continued)

FOREIGN PATENT DOCUMENTS

| | | |
|---|---|---|
| EP | 1 513 116 | 9/2005 |
| WO | WO 2004/014502 | 2/2004 |

(Continued)

*Primary Examiner* — Masud Ahmed
(74) *Attorney, Agent, or Firm* — Neal, Gerber & Eisenberg LLP

(57) ABSTRACT

The present disclosure is directed to a gaming system and method providing a keno game including an additional number triggering event that causes at least one additional number to be added to a selected number set to form a modified number set. A player number set and a gaming system number set are selected from a plurality of numbers. Upon an occurrence of an additional number triggering event, the gaming system adds at least one of the numbers to one of: the player number set to form a modified player number set, and the gaming system number set to form a modified gaming system number set. The gaming system determines any awards based on a comparison of the player number set (or the modified player number set) with the gaming system number set (or the modified gaming system number set), and provides any determined awards.

23 Claims, 10 Drawing Sheets

(56) References Cited

U.S. PATENT DOCUMENTS 5,401,024 A 3/1995 Simunek et al.
5,419,592 A 5/1995 Stuart
5,482,289 A 1/1996 Weingardt
5,569,083 A 10/1996 Fioretti
5,586,937 A 12/1996 Menashe
5,624,119 A 4/1997 Leake
5,628,684 A 5/1997 Bouedec
5,639,089 A 6/1997 Matsumoto et al.
5,647,798 A 7/1997 Falciglia
5,651,735 A 7/1997 Baba
5,674,128 A 10/1997 Holch et al.
5,679,077 A 10/1997 Pocock et al.
5,687,971 A 11/1997 Khaladkar
5,718,631 A 2/1998 Invencion
5,727,786 A 3/1998 Weingardt
5,743,526 A 4/1998 Inoue
5,755,619 A 5/1998 Matsumoto et al.
5,779,545 A 7/1998 Berg et al.
5,800,269 A 9/1998 Holch et al.
5,823,534 A 10/1998 Banyai
5,855,514 A 1/1999 Kamille
5,857,911 A 1/1999 Fioretti
5,871,398 A 2/1999 Schneier et al.
5,909,875 A 6/1999 Weingardt
5,935,001 A 8/1999 Baba
5,935,002 A 8/1999 Falciglia
5,944,606 A 8/1999 Gerow
5,945,655 A 8/1999 Gilgeous et al.
5,949,042 A 9/1999 Dietz, II et al.
5,954,582 A 9/1999 Zach
5,970,143 A 10/1999 Schneier et al.
5,971,849 A 10/1999 Falciglia
6,015,346 A 1/2000 Bennett
6,017,032 A 1/2000 Grippo et al.
6,024,640 A 2/2000 Walker et al.
6,033,306 A 3/2000 DeSouza
6,079,711 A 6/2000 Wei et al.
6,089,976 A 7/2000 Schneider et al.
6,089,982 A 7/2000 Holch et al.
6,099,407 A 8/2000 Parker, Jr. et al.
6,099,408 A 8/2000 Schneir et al.
6,102,400 A 8/2000 Scott et al.
6,102,798 A 8/2000 Bennett
6,117,009 A 9/2000 Yoseloff
6,129,632 A 10/2000 Luciano
6,135,884 A 10/2000 Hedrick et al.
6,146,272 A 11/2000 Walker et al.
6,149,156 A 11/2000 Feola
6,168,521 B1 1/2001 Luciano et al.
6,174,235 B1 1/2001 Walker et al.
6,183,361 B1 2/2001 Cummings et al.
6,186,892 B1 2/2001 Frank et al.
6,203,428 B1 3/2001 Giobbi et al.
6,210,275 B1 4/2001 Olsen
6,210,276 B1 4/2001 Mullins
6,210,279 B1 4/2001 Dickinson
6,217,448 B1 4/2001 Olsen
6,220,961 B1 4/2001 Keane et al.
6,241,606 B1 6/2001 Riendeau et al.
6,250,685 B1 6/2001 Walker et al.
6,251,013 B1 6/2001 Bennett
6,254,480 B1 7/2001 Zach
6,257,980 B1 7/2001 Santini, Jr.
6,261,177 B1 7/2001 Bennett
6,273,820 B1 8/2001 Haste, III
6,280,325 B1 8/2001 Fisk
6,280,328 B1 8/2001 Holch et al.
6,283,855 B1 9/2001 Bingham
6,309,298 B1 10/2001 Gerow
6,309,300 B1 10/2001 Glavich
6,315,290 B1 11/2001 Rothel et al.
6,315,291 B1 11/2001 Moody
6,325,716 B1 12/2001 Walker et al.
6,336,862 B1 1/2002 Byrne
6,346,043 B1 2/2002 Colin et al.
6,358,151 B1 3/2002 Enzminger et al.
6,364,313 B1 4/2002 Moody
6,364,767 B1 4/2002 Brossard et al.
6,368,213 B1 4/2002 McNabola
6,368,214 B1 4/2002 Luciano
6,368,218 B2 4/2002 Angell, Jr.
6,375,570 B1 4/2002 Poole
6,398,644 B1 6/2002 Perrie et al.
6,398,645 B1 6/2002 Yoseloff
6,398,646 B1 6/2002 Wei et al.
6,402,614 B1 6/2002 Schneier et al.
6,419,583 B1 7/2002 Crumby et al.
6,425,823 B1 7/2002 Byrne
6,443,452 B1 9/2002 Brune
6,443,837 B1 9/2002 Jaffe et al.
6,450,883 B1 9/2002 O'Halloran
6,450,885 B2 9/2002 Schneier et al.
6,454,648 B1 9/2002 Kelly et al.
6,464,582 B1 10/2002 Baerlocher et al.
6,475,086 B2 11/2002 Zach
6,478,677 B1 11/2002 Moody
6,482,088 B2 11/2002 Santini, Jr.
6,506,118 B1 1/2003 Baerlocher et al.
6,508,711 B1 1/2003 Ono
6,514,144 B2 2/2003 Riendeau et al.
6,524,184 B1 2/2003 Lind et al.
6,524,185 B2 2/2003 Lind
6,527,638 B1 3/2003 Walker et al.
6,533,660 B2 3/2003 Seelig et al.
6,533,664 B1 3/2003 Crumby
6,537,150 B1 3/2003 Luciano et al.
6,561,900 B1 5/2003 Baerlocher et al.
6,565,091 B2 5/2003 Weingardt
6,565,433 B1 5/2003 Baerlocher et al.
6,569,017 B2 5/2003 Enzminger et al.
6,581,935 B1 * 6/2003 Odom ..... 273/269
6,585,590 B2 7/2003 Malone
6,599,188 B2 7/2003 Hirsch et al.
6,602,137 B2 8/2003 Kaminkow et al.
6,605,001 B1 8/2003 Tarantino
6,607,440 B2 8/2003 Santini, Jr.
6,609,973 B1 8/2003 Weiss
6,632,140 B2 10/2003 Berman et al.
6,645,071 B2 11/2003 Perrie et al.
6,645,072 B1 11/2003 Kellen
6,656,044 B1 12/2003 Lewis
6,656,045 B2 12/2003 Wei et al.
6,666,766 B2 12/2003 Baerlocher et al.
6,672,960 B1 1/2004 B-Jensen
6,676,516 B2 1/2004 Baerlocher et al.
6,682,419 B2 1/2004 Webb et al.
6,682,420 B2 1/2004 Webb et al.
6,692,356 B2 2/2004 Baerlocher et al.
6,695,699 B2 2/2004 Beauileu
6,702,675 B2 3/2004 Poole et al.
6,702,699 B2 3/2004 Touhey et al.
6,722,655 B1 4/2004 Camero
6,722,981 B2 4/2004 Kaminkow et al.
6,722,982 B2 4/2004 Kaminkow et al.
6,729,961 B1 5/2004 Millerschone
6,739,970 B2 5/2004 Luciano
6,749,500 B1 6/2004 Nelson et al.
6,755,738 B2 6/2004 Glasson et al.
6,755,739 B2 6/2004 Santini, Jr.
6,761,632 B2 7/2004 Bansemer et al.
6,764,397 B1 7/2004 Robb
6,780,108 B1 8/2004 Luciano, Jr. et al.
6,783,457 B2 8/2004 Hughs-Baird et al.
6,802,776 B2 10/2004 Lind et al.
6,817,944 B2 11/2004 Kaminkow et al.
6,824,465 B2 11/2004 Luciano, Jr.
6,832,956 B1 12/2004 Boyd et al.
6,835,138 B2 12/2004 Baeg
6,840,858 B2 1/2005 Adams
6,855,054 B2 2/2005 White et al.
6,855,055 B2 2/2005 Perrie et al.
6,875,108 B1 4/2005 Hughs-Baird
6,899,620 B2 5/2005 Kaminkow et al.
6,910,962 B2 6/2005 Marks et al.

(56) References Cited

U.S. PATENT DOCUMENTS 6,958,013 B2 10/2005 Miereau et al.
6,981,635 B1 1/2006 Hughs-Baird et al.
6,991,538 B2 1/2006 Cannon
7,040,984 B2 5/2006 Mead
7,056,213 B2 6/2006 Ching et al.
7,070,505 B2 7/2006 Vancura et al.
7,074,127 B2 7/2006 Cuddy et al.
7,081,050 B2 7/2006 Tarantino
7,094,148 B2 8/2006 Baerlocher et al.
7,104,888 B2 9/2006 Miereau et al.
7,112,137 B2 9/2006 Baerlocher et al.
7,121,942 B2 10/2006 Baerlocher
7,160,186 B2 1/2007 Cuddy et al.
7,160,188 B2 1/2007 Kaminkow et al.
7,172,506 B2 2/2007 Baerlocher et al.
7,175,523 B2 2/2007 Gilmore et al.
7,179,167 B2 * 2/2007 deKeller ..... 463/18
7,182,689 B2 2/2007 Hughs-Baird et al.
7,235,011 B2 6/2007 Randall et al.
7,258,608 B2 8/2007 Khal
7,264,545 B2 9/2007 Maya et al.
7,273,415 B2 9/2007 Cregan et al.
7,291,068 B2 11/2007 Bryant et al.
7,303,469 B2 12/2007 Kaminkow
7,306,519 B2 12/2007 Baerlocher
7,311,598 B2 12/2007 Kaminkow et al.
7,311,604 B2 12/2007 Kaminkow et al.
7,314,409 B2 1/2008 Maya et al.
7,316,609 B2 1/2008 Dunn et al.
7,371,169 B2 5/2008 Baerlocher
7,371,170 B2 5/2008 Cregan et al.
7,377,849 B2 5/2008 Baerlocher et al.
7,399,227 B2 7/2008 Michaelson et al.
7,413,510 B2 8/2008 Schlegel et al.
7,427,236 B2 9/2008 Kaminkow et al.
7,470,186 B2 12/2008 Cannon
7,500,913 B2 3/2009 Baerlocher
7,500,915 B2 3/2009 Wolf et al.
7,507,155 B2 3/2009 Mead et al.
7,544,129 B2 6/2009 Baerlocher
7,547,252 B2 6/2009 Peterson et al.
7,553,230 B2 6/2009 Cannon
7,566,271 B2 7/2009 Hostetler et al.
7,578,735 B2 8/2009 Frizzell et al.
7,682,241 B2 3/2010 Baerlocher
7,708,634 B2 * 5/2010 Padgett ..... 463/19
7,901,282 B2 3/2011 Cannon
8,025,561 B2 9/2011 Reddicks et al.
8,043,153 B2 10/2011 Ross et al.
8,506,384 B2 8/2013 Coleman et al.
2002/0010013 A1 1/2002 Walker et al.
2002/0045472 A1 4/2002 Adams
2002/0052231 A1 5/2002 Fioretti
2002/0052232 A1 5/2002 Kaminkow
2002/0058545 A1 5/2002 Luciano
2002/0072404 A1 6/2002 Gerow
2002/0082070 A1 6/2002 Macke et al.
2002/0094859 A1 7/2002 Hirsch et al.
2002/0098882 A1 7/2002 Lind et al.
2002/0098883 A1 7/2002 Packes, Jr. et al.
2002/0111207 A1 8/2002 Lind et al.
2002/0111214 A1 8/2002 Lind et al.
2002/0113369 A1 8/2002 Weingardt
2002/0117803 A1 8/2002 Weingardt
2002/0137562 A1 9/2002 Malone
2002/0155877 A1 10/2002 Enzminger et al.
2002/0169018 A1 11/2002 Schneier et al.
2002/0177478 A1 11/2002 Glasson et al.
2003/0127793 A1 7/2003 Adams
2003/0130025 A1 7/2003 Gilmore et al.
2003/0144050 A1 7/2003 Keaton
2003/0171986 A1 9/2003 Itkis et al.
2003/0178771 A1 9/2003 Banyai
2003/0181234 A1 9/2003 Falciglia
2003/0193136 A1 10/2003 Walker et al.
2003/0195032 A1 10/2003 Enzminger et al.
2004/0009806 A1 1/2004 Odom
2004/0048647 A1 3/2004 Lind et al.
2004/0053669 A1 3/2004 Gerrard
2004/0106445 A1 6/2004 Perrie et al.
2004/0121834 A1 6/2004 Libby et al.
2004/0130096 A1 7/2004 Duhamel
2004/0152499 A1 8/2004 Lind et al.
2004/0166920 A1 8/2004 Boyd et al.
2004/0176169 A1 9/2004 Lind et al.
2004/0178579 A1 9/2004 Lowell et al.
2004/0204225 A1 10/2004 Camp et al.
2004/0214626 A1 10/2004 Lind et al.
2004/0235555 A1 11/2004 Yarbrough et al.
2004/0242310 A1 12/2004 Perkins
2004/0251628 A1 12/2004 Kilby
2004/0266509 A1 12/2004 Bennett et al.
2005/0014553 A1 1/2005 Byrne
2005/0033461 A1 2/2005 Gerrard
2005/0054404 A1 3/2005 Baerlocher
2005/0054415 A1 3/2005 Kaminkow et al.
2005/0054416 A1 3/2005 Hostetler et al.
2005/0054435 A1 3/2005 Rodgers
2005/0059446 A1 3/2005 Kaminkow
2005/0059449 A1 3/2005 Yarbrough
2005/0059461 A1 3/2005 Ching
2005/0059467 A1 3/2005 Saffari et al.
2005/0059468 A1 3/2005 Cannon
2005/0059469 A1 3/2005 Gail et al.
2005/0059470 A1 3/2005 Cannon
2005/0059471 A1 3/2005 Cannon
2005/0064932 A1 3/2005 Cannon
2005/0075161 A1 4/2005 McGlone et al.
2005/0096119 A1 5/2005 Lind et al.
2005/0096123 A1 5/2005 Cregan et al.
2005/0101370 A1 5/2005 Lind et al.
2005/0101387 A1 5/2005 Wolf
2005/0119042 A1 6/2005 Chamberlain et al.
2005/0119043 A1 6/2005 Berman
2005/0130730 A1 6/2005 Lind et al.
2005/0148382 A1 7/2005 Fox
2005/0164771 A1 7/2005 Lind et al.
2005/0164772 A1 7/2005 Lind et al.
2005/0164773 A1 7/2005 Lind et al.
2005/0167916 A1 8/2005 Banyai
2005/0187014 A1 8/2005 Saffari et al.
2005/0192081 A1 9/2005 Marks et al.
2005/0227753 A1 10/2005 Luciano, Jr.
2005/0255906 A1 11/2005 Lind et al.
2006/0025195 A1 2/2006 Pennington
2006/0025196 A1 2/2006 Webb
2006/0030401 A1 2/2006 Mead et al.
2006/0040732 A1 2/2006 Baerlocher
2006/0068882 A1 3/2006 Baerlocher et al.
2006/0084490 A1 4/2006 Khal
2006/0084494 A1 4/2006 Belger
2006/0084500 A1 4/2006 Baerlocher et al.
2006/0111170 A1 5/2006 Hornik et al.
2006/0189375 A1 8/2006 Dodge
2006/0205473 A1 9/2006 Gomez et al.
2006/0246977 A1 11/2006 Cannon
2007/0021185 A1 1/2007 Walker et al.
2007/0032285 A1 2/2007 Wolf
2007/0077990 A1 4/2007 Cuddy
2007/0105619 A1 5/2007 Kniesteadt
2007/0117611 A1 5/2007 Dodge
2007/0155484 A1 7/2007 Walker
2007/0167217 A1 7/2007 Kaminkow
2008/0102916 A1 5/2008 Kovacs
2008/0102952 A1 5/2008 Walker et al.
2008/0113771 A1 5/2008 Baerlocher
2008/0139274 A1 6/2008 Baerlocher
2008/0153564 A1 6/2008 Baerlocher
2008/0254894 A1 10/2008 Michaelson et al.
2009/0075715 A1 3/2009 Coleman et al.
2009/0197664 A1 8/2009 Schultz
2010/0120489 A1 5/2010 Meyer
2011/0028201 A1 2/2011 Warner et al.

(56) References Cited

U.S. PATENT DOCUMENTS

FOREIGN PATENT DOCUMENTS

| | | |
|---|---|---|
| WO | WO 2004/070551 | 8/2004 |
| WO | WO 2004/105903 | 12/2004 |
| WO | WO 2005/060567 | 7/2005 |
| WO | WO 2005/072096 | 8/2005 |
| WO | WO 2005/079142 | 9/2005 |

* cited by examiner

GAMING SYSTEM AND METHOD PROVIDING A KENO GAME INCLUDING AN ADDITIONAL NUMBER TRIGGERING EVENT THAT CAUSES AT LEAST ONE ADDITIONAL NUMBER TO BE ADDED TO A SELECTED NUMBER SET TO FORM A MODIFIED NUMBER SET

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Keno in the United States traces back to a "Chinese lottery" game brought to the United States by Chinese immigrants in the 1800s. The "Chinese lottery" game utilized a board and a set of up to 120 characters instead of numbers. Early versions of American Keno used characters on Keno tickets rather than the numbers used today. The American Keno game reduced the number of characters to the more familiar eighty.

When gambling was legalized in the state of Nevada in 1931, the "Chinese lottery" game was instead referred to as Horse Race Keno, reflecting the idea that the numbers are horses and the players want their wagered-on horses to come in. Later, the name was shortened to simply Keno, although the game is still often referred to as Horse Race Keno.

Keno is similar to a lottery game. The goal in Keno, like in a lottery, is for a player to choose winning numbers from a plurality of numbers. In most standard versions of paper or video based Keno, a player receives a card with eighty squares numbered one to eighty and arranged in rows of ten. The player can wager on any number or numbers up to a designated quantity of numbers, such as ten numbers. The player chooses numbers on which the player desires to wager by marking those numbers on a Keno card (such as in a paper version of Keno) or by selecting the numbers on a keno display (such as in a video version of Keno). A clerk or the processor of the video display records the player's wager(s). The player pays for each number played or wagered on.

In one known paper version, the Keno numbers also appear on eighty ping pong type balls that can be tossed about in a clear plastic sphere or spun around in a wire bird cage. Keno numbers were at one time drawn from such apparatuses using a manually powered Keno goose. In one known video version, a computer generates the Keno numbers using a random number generator. After a number is chosen, that number is shown electronically on Keno boards throughout the casino or on the video display. An award is provided to the player based on a quantity of matches between the player selected number(s) and the game generated number(s).

Many casinos offer "multi-race" cards, which allow the player to play the same set of numbers over multiple games. One type of "multi" game allows the player to wager on a single set of numbers over as many as twenty games. When finished, the player must return to the Keno station and cash in any wins. "Stray and play" tickets are also available, and allow the player to play a version of Keno called "walk away Keno." Here, players can purchase a Keno ticket for an extended number of games, enjoy other activities in the casino, and return at a later time or even a later date to have the tickets checked by a computer for winning games.

Another option for Keno players is a combination or "way" ticket. A combination ticket enables the player to group different numbers, wherein each group has the same amount numbers, creating more than one way to win. For example, a 3×3×3, nine spot ticket allows the player, to select a combination of three groups of three numbers. The player can, for example, mark a first group of three numbers with the letter "A," mark a second group with the letter "B," and mark a third group the letter "C." This ticket enables the player to win on any winning combination of three numbers for any of the three groups. Hitting any winning combination pays as though a single ticket had been played. Essentially, the player plays three games on one card. In some Keno games, playing three numbers in three games enables the player to play, or provides to the player, an additional nine spot game.

The 'way' ticket supposedly makes Keno more exciting, enabling players to wager more money on more numbers. In reality, playing a way or combination ticket offers no mathematical advantage, and no disadvantage, to the player. Some casinos offer discounted minimum wagers with 'way' tickets. If the player plays three or more ways, many casinos will discount the price per 'way' (e.g., let the player wager $0.50 per wager instead of a usual $1 minimum). However, the casino only pays back on the player's actual wager.

Certain variations of Keno have expected returns that are relatively constant regardless of how many numbers the player plays. That is, it does not mathematically matter how many numbers the player chooses or if the player combines wagers. The player can choose fewer numbers if the player likes to win a smaller amount but a little more often. The player can choose more numbers if the player does not care about the frequency of the wins but wants bigger payouts. In other versions, the expected value fluctuates based on how many numbers the player plays.

Keno is a popular game that has been embodied in various types of gaming devices. A need exists to provide variations of Keno to make the play of Keno more enjoyable, fun, and exciting for players. In particular, there is a need to increase the fun and excitement associated with selecting the player's numbers and/or the game generated numbers.

SUMMARY

Various embodiments of the present disclosure are directed to a gaming system and method providing a keno game including an additional number triggering event that causes at least one additional number to be added to a selected number set to form a modified number set. In certain embodiments, the keno game is associated with a plurality of numbers including one or more designated numbers. The gaming system receives a selection of one or more of the numbers (such as from a player) to form a player number set. The gaming system selects one or more of the numbers to form a gaming system number set. Upon an occurrence of an additional number triggering event, the gaming system adds at least one of the numbers to one of: (a) the player number set to form a modified player number set, and (b) the gaming system number set to form a modified gaming system number set. If at least one of the numbers was added to the player number set to form the modified player number set, the gaming system determines any awards based on a comparison of the modified player number set with the gaming system number set. If at least one of the numbers was added to the gaming system number set to form the modified gaming system number set, the gaming system determines any awards based on a comparison of the player number set with the modified gaming system number set. The gaming system provides any determined awards.

In one embodiment in which the keno game is associated with a plurality of numbers including one or more designated numbers, for a play of the keno game, the gaming system receives a selection of a plurality of the numbers from a player to form a player number set. The gaming system randomly selects one or more of the numbers to form a gaming system number set. The gaming system determines whether one of the designated numbers was selected to form the gaming system number set. If one of the designated numbers was selected to form the gaming system number set, the gaming system randomly selects one or more of the numbers not selected to form the gaming system number set and adds the randomly selected number(s) to the gaming system number set to form a modified gaming system number set. The gaming system determines any awards based on a comparison of the player number set and the modified gaming system number set. The gaming system provides any determined awards.

In one embodiment, the additional number triggering event occurs when one of the designated numbers is selected to form the player number set, and the additional number triggering event does not occur when the gaming system selects one of the designated numbers to form the gaming system number set. In another embodiment, the additional number triggering event occurs when the gaming system selects one of the designated numbers to form the gaming system number set, and the additional number triggering event does not occur when one of the designated numbers is selected to form the player number set. In a further embodiment, the additional number triggering event occurs when one of the designated numbers is selected to form the player number set and/or when the gaming system selects one of the designated numbers to form the gaming system number set. That is, in this embodiment, the additional number triggering event occurs when: (a) one of the designated numbers is selected to form the player number set, (b) the gaming system selects one of the designated numbers to form the gaming system number set, or (c) one of the designated numbers is selected to form the player number set and the gaming system selects one of the designated numbers to form the gaming system number set.

In one embodiment, upon an occurrence of the additional number triggering event, the gaming system randomly determines which of the numbers to add to the gaming system number set and/or the player number set to form the modified gaming system number set and/or the modified player number set. In another embodiment, upon an occurrence of the additional number triggering event, the gaming system determines which of the numbers to add to the gaming system number set and/or the player number set to form the modified gaming system number set and/or the modified player number set based on a proximity of the numbers to a designated number included in one of the player number set and the gaming system number set. In another embodiment, upon an occurrence of the additional number triggering event, the gaming system determines which of the numbers to add to the gaming system number set and/or the player number set to form the modified gaming system number set and/or the modified player number set based on one or more predetermined patterns.

It should thus be appreciated that the keno game of the present disclosure provides an increased level of excitement and enjoyment for certain players.

Additional features and advantages are described herein, and will be apparent from, the following Detailed Description and the Figures.

DETAILED DESCRIPTION

Figure 1:
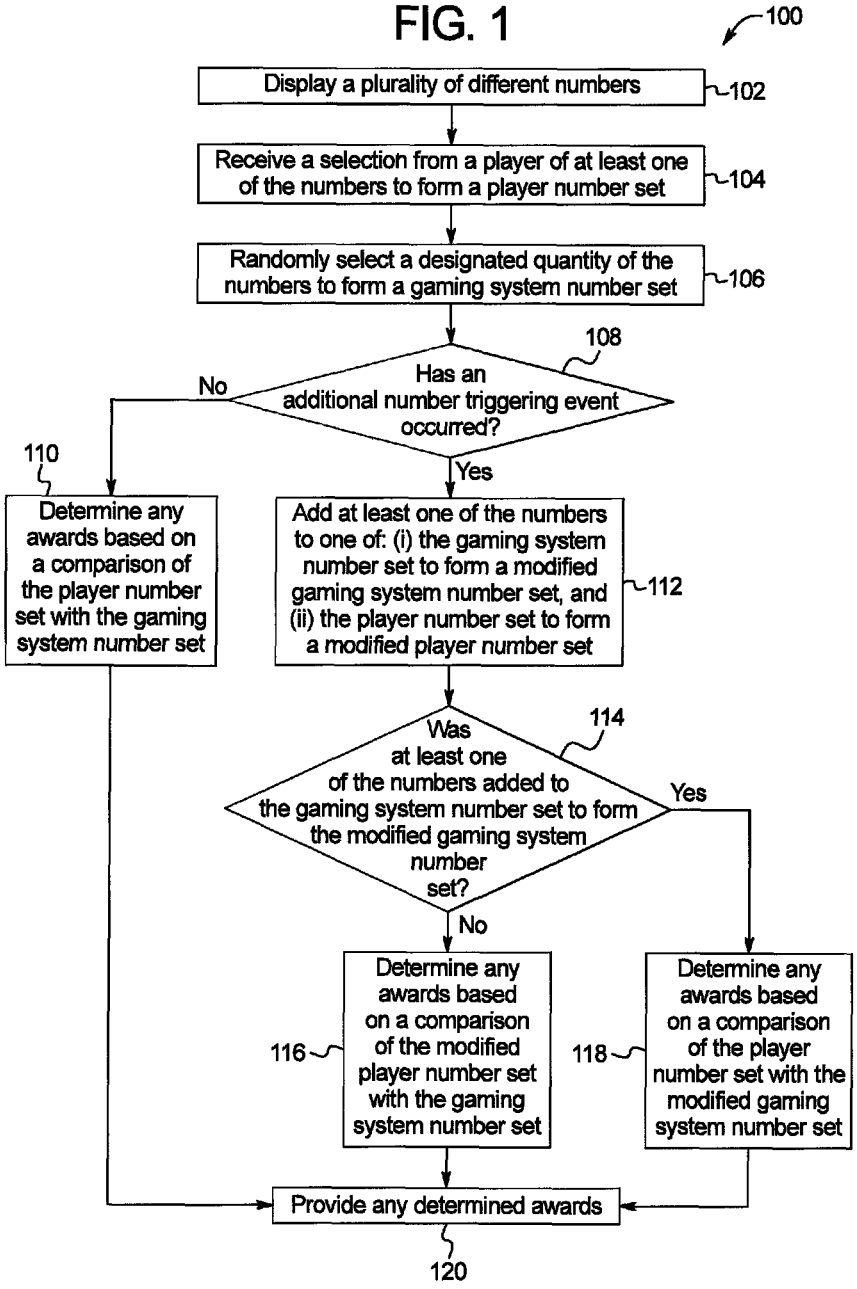
FIG. 1 is a flowchart illustrating an example method of operating an embodiment of the gaming system of the present disclosure.

Keno Game Including an Additional Number Triggering Event that Causes at Least One Additional Number to be Added to a Selected Number Set to Form a Modified Number Set Various embodiments of the present disclosure are directed to a gaming system and method providing a keno game including an additional number triggering event that causes at least one additional number to be added to a selected number set to form a modified number set. In certain embodiments, the keno game is associated with a plurality of numbers including one or more designated numbers. The gaming system receives a selection of one or more of the numbers (such as from a player) to form a player number set. The gaming system selects one or more of the numbers to form a gaming system number set. Upon an occurrence of an additional number triggering event, the gaming system adds at least one of the numbers to one of: (a) the player number set to form a modified player number set, and (b) the gaming system number set to form a modified gaming system number set. If at least one of the numbers was added to the player number set to form the modified player number set, the gaming system determines any awards based on a comparison of the modified player number set with the gaming system number set. If at least one of the numbers was added to the gaming system number set to form the modified gaming system number set, the gaming system determines any awards based on a comparison of the player number set with the modified gaming system number set. The gaming system provides any determined awards.

In certain embodiments, the gaming system of the present disclosure is configured to operate the keno game as a primary game operable upon a wager by a player. In other embodiments, the gaming system is configured to operate the keno game as a secondary or bonus game. In various embodiments, the keno game is operable upon a wager of one or more of: (a) monetary credits, (b) currency, (c) non-monetary credits, (d) promotional credits, and (e) player tracking points or credits.

In various embodiments, the keno game of the present disclosure is associated with a plurality of different numbers. In one embodiment, the keno game includes the numbers 1 through 80, though it should be appreciated that the keno game may be associated with any suitable numbers or range of numbers. It should also be appreciated that, in certain embodiments, the keno game employs any suitable symbols (such as letters, characters, themed images, and the like) rather than numbers. In various embodiments, for a play of the keno game, one or more of the numbers are designated numbers. That is, for a play of the keno game in such embodiments, one of; a plurality of, but less than all of; or all of the numbers are designated numbers. In various embodiments, a quantity of the numbers that are designated numbers for a play of the keno game is: (a) predetermined, (b) randomly determined by the gaming system, (c) determined based on one or more probability tables, (d) determined based on game play, (e) determined based on a player tracking status of a player, (f) determined based on time, (g) determined based on a wager placed by a player, or (h) determined based on any other suitable factor(s) or in any other suitable manner(s). In certain embodiments, the specific numbers that are designated numbers for a play of the keno game are: (a) predetermined, (b) randomly determined by the gaming system, (d) determined based on one or more probability tables, (d) determined based on game play, (e) determined by a player (such as via player selection), (f) determined based on a player tracking status of a player, (g) determined based on time, (h) determined based on a wager placed by a player, or (i) determined based on any other suitable factor(s) or in any other suitable manner(s).

In various embodiments, the gaming system displays a plurality of positions and an indication of a different one of the numbers at each of the positions. In one embodiment, the gaming system displays a quantity of positions that is equal to a quantity of the numbers of the keno game. For example, the gaming system displays eighty positions and an indication of a different one of the numbers 1 through 80 at each of the positions. It should be appreciated that, in certain embodiments, the gaming system does not indicate which of the numbers are designated numbers, while in other embodiments the gaming system indicates which of the numbers are designated numbers.

In certain embodiments, one or more of the numbers are selected to form a player number set. In various embodiments, the gaming system enables a player to select which specific numbers to include in the player number set. In one such embodiment, the gaming system enables the player to select at least a first quantity of the numbers but no more than a second greater quantity of the numbers. In one example, the gaming system enables the player to select at least four of the numbers but no more than ten of the numbers to form the player number set. In another example, the gaming system enables the player to select at least one of the numbers but no more than fifteen of the numbers to form the player number set. It should be appreciated that the gaming system may enable the player to select any suitable quantity of the numbers or any suitable quantity of the numbers within any suitable range of quantities. In another embodiment, the gaming system enables the player to instruct the gaming system to randomly select one or more of the numbers to include in the player number set. That is, in this embodiment, the gaming system selects which specific numbers to include in the player number set.

The gaming system randomly selects a designated quantity of the numbers to form a gaming system number set. In one example, the designated gaming system selects a quantity of twenty of the numbers, though it should be appreciated that the designated quantity of the numbers selected by the gaming system may be any suitable quantity. In certain embodiments, the designated quantity of the numbers is greater than a quantity of the numbers in the player number set. In other embodiments, the designated quantity of the numbers is equal to the quantity of the numbers in the player number set. In further embodiments, the designated quantity of the numbers is less than the quantity of the numbers in the player number set.

The gaming system determines whether an additional number triggering event occurs. In one embodiment, the additional number triggering event occurs when one of the designated numbers is selected to form the player number set, and the additional number triggering event does not occur when the gaming system selects one of the designated numbers to form the gaming system number set. In another embodiment, the additional number triggering event occurs when the gaming system selects one of the designated numbers to form the gaming system number set, and the additional number triggering event does not occur when one of the designated numbers is selected to form the player number set. In a further embodiment, the additional number triggering event occurs when one of the designated numbers is selected to form the player number set and/or when the gaming system selects one of the designated numbers to form the gaming system number set. That is, in this embodiment, the additional number triggering event occurs when: (a) one of the designated numbers is selected to form the player number set, (b) the gaming system selects one of the designated numbers to form the gaming system number set, or (c) one of the designated numbers is selected to form the player number set and the gaming system selects one of the designated numbers to form the gaming system number set.

In one embodiment, the additional number triggering event is active (i.e., may occur) for each play of the keno game. In another embodiment, the additional number triggering event is active based on a placement of a secondary wager by the player in addition to any primary wager. That is, in this embodiment, the gaming system requires the player to place the secondary wager to activate the additional number triggering event for a play of the keno game. In a further embodiment, the additional number triggering event is active if the player places a wager that reaches or exceeds a predetermined wager threshold.

In various embodiments, upon an occurrence of the additional number triggering event, the gaming system adds at least one of the numbers to one of: (a) the player number set to form a modified player number set, and (b) the gaming system number set to form a modified gaming system number set. More specifically, in various embodiments in which the additional number triggering event occurs when one of the designated numbers is selected to form the player number set, when one of the designated numbers is selected to form the player number set, the gaming system determines at least one of the numbers not selected to form the player number set (i.e., one of the numbers not included in the player number set) to add to the player number set to form the modified player number set. Further, in certain embodiments in which the additional number triggering event occurs when the gaming system selects one of the designated numbers to form the gaming system number set, when the gaming system selects one of the designated numbers to form the gaming system number set, the gaming system determines at least one of the numbers not selected to form the gaming system number set (i.e., one of the numbers not included in the gaming system number set) to add to the gaming system number set to form the modified gaming system number set.

In certain embodiments in which the additional number triggering event occurs when one of the designated numbers is selected to form the player number set, upon an occurrence of the additional number triggering event, the gaming system randomly determines which specific numbers not selected to form the player number set to add to the player number set to form the modified player number set. In one such embodiment, a quantity of the numbers not selected to form the player number set to add to the player number set to form the modified player number set is predetermined. In another such embodiment, the gaming system randomly determines the quantity of the numbers not selected to form the player number set to add to the player number set to form the modified player number set. In other such embodiments, the quantity of the numbers not selected to form the player number set to add to the player number set to form the modified player number set is determined: (a) based on one or more probability tables, (b) based on game play, (c) based on a player tracking status of a player, (d) based on time, (e) based on a wager placed by a player, or (f) based on any other suitable factor(s) or in any other suitable manner(s).

Similarly, in certain embodiments in which the additional number triggering event occurs when the gaming system selects one of the designated numbers to form the gaming system number set, upon an occurrence of the additional number triggering event, the gaming system randomly determines which specific numbers not selected to form the gaming system number set to add to the gaming system number set to form the modified gaming system number set. In one such embodiment, a quantity of the numbers not selected to form the gaming system number set to add to the gaming system number set to form the modified gaming system number set is predetermined. In another such embodiment, the gaming system randomly determines the quantity of the numbers not selected to form the gaming system number set to add to the gaming system number set to form the modified gaming system number set. In other embodiments, the quantity of the numbers not selected to form the gaming system number set to add to the gaming system number set to form the modified gaming system number set is determined: (a) based on one or more probability tables, (b) based on game play, (c) based on a player tracking status of a player, (d) based on time, (e) based on a wager placed by a player, or (f) based on any other suitable factor(s) or in any other suitable manner(s).

In certain embodiments in which the additional number triggering event occurs when one of the designated numbers is selected to form the player number set, upon an occurrence of the additional number triggering event, the gaming system determines which of the numbers not selected to form the player number set to add to the player number set to form the modified player number set based at least in part on a proximity of the displayed indication of the selected designated number to the displayed indications of each of the numbers not selected to form the player number set. In one such embodiment, numbers having indications displayed in relatively close proximity to the displayed indication of the selected designated number have a relatively higher probability of being selected to form the modified player number set than numbers having indications that are displayed relatively far from the displayed indication of the selected designated number. Put differently, in this embodiment, the gaming system is more likely to select numbers having indications displayed relatively close to the displayed indication of the selected designated number to form the modified player number set than numbers having indications displayed relatively far from the displayed indication of the selected designated number. In one example, a first number having an indication displayed a first distance from a displayed indication of a selected designated number has a first probability of being selected to form the modified player number set that is greater than a second probability of being selected to form the modified player number set associated with a second number having an indication displayed a second greater distance from the displayed indication of the selected designated number.

In another such embodiment, numbers not selected to form the player number set having indications displayed in relatively close proximity to the displayed indication of the selected designated number have a relatively lower probability of being selected to form the modified player number set than numbers not initially selected by the player having indications that are displayed relatively far from the displayed indication of the selected designated number. That is, in this embodiment, the gaming system is more likely to select numbers having indications displayed relatively far from the displayed indication of the selected designated number to form the modified player number set than numbers having indications displayed relatively close to the displayed indication of the selected designated number. In one example, a first number having an indication displayed a first distance from a displayed indication of a selected designated number has a first probability of being selected to form the modified player number set that is less than a second probability of being selected to form the modified player number set associated with a second number having an indication displayed a second greater distance from the displayed indication of the selected designated number.

Thus, in these embodiments, for each number not selected to form the player number set, whether or not the gaming system selects that number to form the modified player number set is based at least in part on a distance of the displayed indication of that number from the displayed indication of the selected designated number. It should be appreciated that, in certain such embodiments, the quantity of the numbers to add to the player number set to form the modified player number set is: (a) predetermined, (b) randomly determined, (c) determined based on one or more probability tables, (d) determined based on game play, (e) determined based on a player tracking status of a player, (f) determined based on time, (g) determined based on a wager placed by a player, or (h) determined based on any other suitable factor(s) or in any other suitable manner(s).

Similarly, in certain embodiments in which the additional number triggering event occurs when the gaming system selects one of the designated numbers to form the gaming system number set, upon an occurrence of the additional number triggering event, the gaming system determines which of the numbers not selected to form the gaming system number set to add to the gaming system number set to form the modified gaming system number set based at least in part on a proximity of the displayed indication of the selected designated number to the displayed indications of each of the numbers not selected to form the gaming system number set. In one such embodiment, numbers having indications displayed in relatively close proximity to the displayed indication of the selected designated number have a relatively higher probability of being selected to form the modified gaming system number set than numbers having indications that are displayed relatively far from the displayed indication of the selected designated number. Put differently, in this embodiment, the gaming system is more likely to select numbers having indications displayed relatively close to the displayed indication of the selected designated number to form the modified gaming system number set than numbers having indications displayed relatively far from the displayed indication of the selected designated number. In one example, a first number having an indication displayed a first distance from a displayed indication of a selected designated number has a first probability of being selected to form the modified gaming system number set that is greater than a second probability of being selected to form the modified gaming system number set associated with a second number having an indication displayed a second greater distance from the displayed indication of the selected designated number.

In another such embodiment, numbers not selected to form the gaming system number set having indications displayed in relatively close proximity to the displayed indication of the selected designated number have a relatively lower probability of being selected to form the modified gaming system number set than numbers not initially selected by the gaming system having indications that are displayed relatively far from the displayed indication of the selected designated number. That is, in this embodiment, the gaming system is more likely to select numbers having indications displayed relatively far from the displayed indication of the selected designated number for inclusion in the modified gaming system number set than numbers having indications displayed relatively close to the displayed indication of the selected designated number. In one example, a first number having an indication displayed a first distance from a displayed indication of a selected designated number has a first probability of being selected to form the modified gaming system number set that is less than a second probability of being selected to form the modified gaming system number set associated with a second number having an indication displayed a second greater distance from the displayed indication of the selected designated number.

Thus, in these embodiments, for each number not selected to form the gaming system number set, whether or not the gaming system selects that number to form the modified gaming system number set is based at least in part on a distance of the displayed indication of that number from the displayed indication of the selected designated number. It should be appreciated that, in certain such embodiments, the quantity of the numbers to add to the gaming system number set to form the modified gaming system number set is: (a) predetermined, (b) randomly determined, (c) determined based on one or more probability tables, (d) determined based on game play, (e) determined based on a player tracking status of a player, (f) determined based on time, (g) determined based on a wager placed by a player, or (h) determined based on any other suitable factor(s) or in any other suitable manner(s).

In further embodiments in which the additional number triggering event occurs when one of the designated numbers is selected to form the player number set, upon an occurrence of the additional number triggering event, the gaming system determines which of the numbers not selected to form the player number set to add to the player number set to form the modified player number set based on one or more of a plurality of patterns. In one such embodiment, upon an occurrence of the additional number triggering event, the gaming system adds the numbers not selected to form the player number set having indications displayed in a same row as the indication of the selected designated number to the player number set to form the modified player number set. In another such embodiment, upon an occurrence of the additional number triggering event, the gaming system adds the numbers not selected to form the player number set having indications displayed in a same column as the indication of the selected designated number to the player number set to form the modified player number set. In another such embodiment, upon an occurrence of the additional number triggering event, the gaming system adds the numbers not selected to form the player number set having indications displayed in a same diagonal line on which the indication of the selected designated number is displayed to the player number set to form the modified player number set. In one such embodiment, upon an occurrence of the additional number triggering event, the gaming system adds the numbers not selected to form the player number set having indications displayed surrounding (i.e., immediately adjacent to) the displayed indication of the selected designated number to the player number set to form the modified player number set. It should be appreciated that, in various embodiments, the gaming system adds the numbers not selected to form the player number set having indications displayed according to any suitable pattern to the player number set to form the modified player number set.

Similarly, in further embodiments in which the additional number triggering event occurs when the gaming system selects one of the designated numbers to form the gaming system number set, upon an occurrence of the additional number triggering event, the gaming system determines which of the numbers not selected to form the gaming system number set to add to the gaming system number set to form the modified gaming system number set based on one or more of a plurality of patterns. In one such embodiment, upon an occurrence of the additional number triggering event, the gaming system adds the numbers not selected to form the gaming system number set having indications displayed in a same row as the indication of the selected designated number to the gaming system number set to form the modified gaming system number set. In another such embodiment, upon an occurrence of the additional number triggering event, the gaming system adds the numbers not selected to form the gaming system number set having indications displayed in a same column as the indication of the selected designated number to the gaming system number set to form the modified gaming system number set. In another such embodiment, upon an occurrence of the additional number triggering event, the gaming system adds the numbers not selected to form the gaming system number set having indications displayed in a same diagonal line on which the indication of the selected designated number is displayed to the gaming system number set to form the modified gaming system number set. In one such embodiment, upon an occurrence of the additional number triggering event, the gaming system adds the numbers not selected to form the gaming system number set having indications displayed surrounding (i.e., immediately adjacent to) the displayed indication of the selected designated number to the gaming system number set to form the modified gaming system number set. It should be appreciated that, in various embodiments, the gaming system adds the numbers not selected to form the gaming system number set having indications displayed according to any suitable pattern to the gaming system number set to form the modified gaming system number set.

In one embodiment in which the additional number triggering event occurs when one of the designated numbers is selected to form the player number set, upon an occurrence of the additional number triggering event, the gaming system determines which of the numbers not selected to form the player number set to add to the player number set to form the modified player number set based on which designated number was selected. More specifically, in this embodiment, for each designated number, that designated number is associated with a predetermined set of one or more of the numbers.

When the gaming system receives a selection of that designated number to form the player number set (i.e., when the additional number triggering event occurs in this embodiment), the gaming system adds the numbers of the predetermined set not already selected to form the player number set to the player number set to form the modified player number set.

Similarly, in one embodiment in which the additional number triggering event occurs when the gaming system selects one of the designated numbers to form the gaming system number set, upon an occurrence of the additional number triggering event, the gaming system determines which of the numbers not selected to form the gaming system number set to add to the gaming system number set to form the modified gaming system number set based on which designated number was selected. More specifically, in this embodiment, for each designated number, that designated number is associated with a predetermined set of one or more of the numbers. When the gaming system selects that designated number to form the gaming system number set (i.e., when the additional number triggering event occurs in this embodiment), the gaming system adds the numbers of the predetermined set not already selected to form the gaming system number set to the gaming system number set to form the modified gaming system number set.

In another embodiment in which the additional number triggering event occurs when one of the designated numbers is selected to form the player number set, upon an occurrence of the additional number triggering event, the gaming system adds the numbers not selected to form the player number set to the player number set to form the modified player number set.

Similarly, in another embodiment in which the additional number triggering event occurs when the gaming system selects one of the designated numbers to form the gaming system number set, upon an occurrence of the additional number triggering event, the gaming system adds the numbers not selected to form the gaming system number set to the gaming system number set to form the modified gaming system number set.

In certain embodiments in which the additional number triggering event occurs when one of the designated numbers is selected to form the player number set, upon an occurrence of the additional number triggering event, the gaming system enables the player to select the specific numbers not selected to form the player number set to add to the player number set to form the modified player number set. In these embodiments, the quantity of the numbers to add to the player number set to form the modified player number set is: (a) predetermined, (b) randomly determined, (c) determined based on one or more probability tables, (d) determined based on game play, (e) determined based on a player tracking status of a player, (f) determined based on time, (g) determined based on a wager placed by a player, or (h) determined based on any other suitable factor(s) or in any other suitable manner(s).

It should be appreciated that the present disclosure contemplates certain embodiments that employ two or more of the above manners of determining: (a) the quantity of numbers to add to the player number set to form the modified player number set and/or the quantity of numbers to add to the gaming system number set to form the modified gaming system number set, and/or (b) which specific numbers to add to the player number set to form the modified player number set and/or which specific numbers to add to the gaming system number set to form the modified gaming system number set.

In certain embodiments, the additional number triggering event also occurs when one of the designated numbers is selected to form one of the modified number sets. In one such embodiment, the additional number triggering event occurs when one of the designated numbers is selected to form the modified player number set. Upon such an occurrence of the additional number triggering event, the gaming system selects one or more numbers (such as by using any of the above-described methods) to add to the modified player number set to form a further modified player number set. In another such embodiment, the additional number triggering event occurs when the gaming system selects one of the designated numbers to form the modified gaming system number set. Upon such an occurrence of the additional number triggering event, the gaming system selects one or more numbers (such as by using any of the above-described methods) to add to the modified gaming system number set to form a further modified gaming system number set. Thus, in these embodiments, the gaming system selects one or more numbers to add to one of the number sets each time one of the designated numbers is added to one of the number sets.

In other embodiments in which the additional number triggering event occurs when one of the designated numbers is selected to form the player number set, when one of the designated numbers is selected to form the player number set, the gaming system determines at least one of the numbers in any of the manners described above. That is, in these embodiments, the gaming system determines at least one of the entire plurality of numbers (which includes any numbers already selected to form the player number set). In these embodiments, when the gaming system determines one of the numbers not selected to form the player number set (i.e., one of the numbers not included in the player number set), the gaming system adds that determined number the player number set to form the modified player number set. In these embodiments, when the gaming system determines one of the numbers already selected to form the player number set (i.e., one of the numbers included in the player number set), the gaming system determines and provides the player a modifier (such as a multiplier) for use in a play of the keno game. It should be appreciated that the gaming system may determine a value of the modifier randomly, based on game play, or in any suitable manner or based on any suitable factor or factors. In other such embodiments, the gaming system provides a bonus award instead of or in addition to a modifier.

In other embodiments in which the additional number triggering event occurs when the gaming system selects one of the designated numbers to form the gaming system number set, when the gaming system selects one of the designated numbers to form the gaming system number set, the gaming system determines at least one of the numbers in any of the manners described above. That is, in these embodiments, the gaming system determines at least one of the entire plurality of numbers (which includes any numbers already selected to form the gaming system number set). In these embodiments, when the gaming system determines one of the numbers not selected to form the gaming system number set (i.e., one of the numbers not included in the gaming system number set), the gaming system adds that determined number the gaming system number set to form the modified gaming system number set. In these embodiments, when the gaming system determines one of the numbers already selected to form the gaming system number set (i.e., one of the numbers included in the gaming system number set), the gaming system determines and provides the player a modifier (such as a multiplier) for use in a play of the keno game. It should be appreciated that the gaming system may determine a value of the modifier randomly, based on game play, or in any suitable manner or based on any suitable factor or factors. In other such embodiments, the gaming system provides a bonus award instead of or in addition to a modifier In various embodiments in which the additional number triggering event occurs when one of the designated numbers is selected to form the player number set, if at least one of the numbers was added to the player number set to form the modified player number set, the gaming system determines any awards based on a comparison of the numbers of the modified player number set with the numbers of the gaming system number set. If not, the gaming system determines any awards based on a comparison of the numbers of the player number set with the numbers of the gaming system number set.

Similarly, in various embodiments in which the additional number triggering event occurs when the gaming system selects one of the designated numbers to form the gaming system number set, if at least one of the numbers was added to the gaming system number set to form the modified gaming system number set, the gaming system determines any awards based on a comparison of the numbers of the player number set with the numbers of the modified gaming system number set. If not, the gaming system determines any awards based on a comparison of the numbers of the player number set with the numbers of the gaming system number set.

Similarly, in various embodiments in which the additional number triggering event occurs when either: (a) one of the designated numbers is selected to form the player number set, (b) the gaming system selects one of the designated numbers to form the gaming system number set, or (c) one of the designated numbers is selected to form the player number set and the gaming system selects one of the designated numbers to form the gaming system number set, if at least one of the numbers was added to the player number set to form the modified player number set, the gaming system determines any awards based on a comparison of the numbers of the modified player number set with the numbers of the gaming system number set. If at least one of the numbers was added to the gaming system number set to form the modified gaming system number set, the gaming system determines any awards based on a comparison of the numbers of the player number set with the numbers of the modified gaming system number set. If at least one of the numbers was added to the player number set to form the modified player number set and at least one of the numbers was added to the gaming system number set to form the modified gaming system number set, the gaming system determines any awards based on a comparison of the numbers of the modified player number set with the numbers of the modified gaming system number set. If no numbers were added to either the player number set or the gaming system number set, the gaming system determines any awards based on a comparison of the numbers of the player number set with the numbers of the gaming system number set.

The gaming system compares the numbers of the set of (or the modified set of) player-selected numbers with the numbers of the set of (or the modified set of) gaming system-selected numbers to determine a quantity of matching numbers and determines any awards based on the determined quantity of matching numbers. More specifically, the determined quantity of matching numbers represents how many numbers of the set of (or the modified set of) player-selected numbers match the numbers of the set of (or the modified set of) gaming system-selected numbers. For example, the player number set includes the following numbers: 1, 3, 5, 7, and 9, and the gaming system number set includes the following numbers: 1, 2, 5, 6, and 9. In this example, the quantity of matching numbers is equal to three because the player number set and the gaming system number set both include the numbers 1, 5, and 9. In various embodiments, the gaming system determines any awards based on the determined quantity of matching numbers.

In various embodiments, the paytable includes a maximum quantity of matching numbers for which the gaming system provides an award. In one example, the provides awards for quantities of matching numbers from three matches up to and including a maximum of ten matching numbers. In one embodiment, the gaming system does not provide any additional awards if the occurrence of the additional number triggering event causes the quantity of matching numbers to exceed the maximum quantity of matching numbers. In another embodiment, the gaming system provides a bonus award, such as a monetary credit award, a non-monetary credit award, an award or player tracking points, a comp award, or any other suitable type of award if the occurrence of the additional number triggering event causes the quantity of matching numbers to exceed the maximum quantity of matching numbers. In another embodiment, the gaming system does not provide any additional awards if the occurrence of the additional number triggering event causes the quantity of matching numbers to exceed the maximum quantity of matching numbers, but carries over any excess matches to a subsequent play of the keno game. In another embodiment, the gaming system provides a modifier such as a multiplier if the occurrence of the additional number triggering event causes the quantity of matching numbers to exceed the maximum quantity of matching numbers. In one example, a value of the modifier is determined based on the quantity of matching numbers in excess of the maximum quantity.

Examples

FIG. 1 illustrates a flowchart of an example process or method 100 for operating an example gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In this example, for a play of the keno game, the gaming system displays a plurality of different numbers, as indicated by block 102. The gaming system receives a selection from a player of at least one of the numbers to form a player number set, as indicated by block 104. The gaming system randomly selects a designated quantity of the numbers to form a gaming system number set, as indicated by block 106. The gaming system determines whether an additional number triggering event occurred, as indicated by diamond 108. If the additional number triggering event did not occur, the gaming system determines any awards based on a comparison of the player number set with the gaming system number set, as indicated by block 110. Process 100 proceeds to block 120, described below.

If the additional number triggering event occurred, the gaming system adds at least one of the numbers to one of: (i) the gaming system number set to form a modified gaming system number set, or (ii) the player number set to form a modified player number set, as indicated by block 112. The gaming system determines whether at least one of the numbers was added to the gaming system number set to form the modified gaming system number set, as indicated by block 114. If the gaming system determines that none of the numbers were added to the gaming system number set to form the modified gaming system number (i.e., determines that at least one of the numbers was added to the player number set to form the modified player number set), the gaming system determines any awards based on a comparison of the modified player number set with the gaming system number set, as indicated by block 116. Process 100 proceeds to block 120, described below. If the gaming system determines that at least one of the numbers was added to the gaming system number set to form the modified gaming system number set, the gaming system determines any awards based on a comparison of the player number set with the modified gaming system number set, as indicated by block 118. The gaming system provides any determined awards, as indicated by block 120.

FIGS. 2A, 2B, 2C, 2D, and 2E illustrate screen shots of an example embodiment of the gaming system of the present disclosure configured to operate an example keno game. In this example, the keno game is associated with the numbers 1 through 80. For each play of the keno game, the gaming system displays an indication of each of the numbers, enables the player to select ten numbers to form the player number set, and randomly selects twenty numbers to form the gaming system number set. Additionally, for each play of the keno game in this example, the gaming system randomly selects one of the numbers to be a designated number for that play of the keno game. In this example, the additional number triggering event occurs when the gaming system randomly selects the designated number to form the gaming system number set, and the additional number triggering event does not occur when the player selects the designated number to form the player number set. When the additional number triggering event occurs, the gaming system adds each number having an indication displayed surrounding (i.e., immediately adjacent to) the displayed indication of the designated number to the gaming system number set to form a modified gaming system number set. The gaming system then determines any awards by comparing the player number set with the modified gaming system number set, and provides any determined awards.

In this example, the gaming system displays (such as on a display device 1116 or 1118, described below) a keno board 200 including a plurality of keno board positions 201 through 280. The gaming system displays an indication of a different one of the numbers 1 through 80 at each of the keno board positions. Additionally, in this example, the gaming system displays an indication, notification, or message display area 291, which displays information, notifications, and/or messages before, during, or after play of the keno game. The gaming system also displays: a credit meter 294, which displays a player's credit balance in the form of an amount of credit in this example; a wager indicator 296, which displays the player's primary wager in the form of an amount of credit in this example; and an award meter 298, which displays any awards won by the player in the form of an amount of credit in this example. While in this illustrated example the gaming system indicates the player's credit balance, the player's wager, and any awards in the form of amounts of credit, it should be appreciated that such indications may alternatively or additionally be made in the form of amounts of currency. Moreover, while the player's credit balance, the player's wager, and any awards are displayed as an amount of monetary credit in this example, one or more of such player's credit balance, such player's wager, and any awards may be for non-monetary credits, promotional credits, and/or player tracking points or credits.

The gaming system displays a paytable 292 for the keno game. Paytable 292 indicates a plurality of quantities of matching numbers and an award associated with each such quantity of matching numbers. In this example, paytable 292 indicates a credit payout associated with each respective quantity of matching numbers when the maximum wager, which is 10 credits in this example (but could be any suitable amount), is placed for a play of the keno game. In this illustrated example: a quantity of zero matching numbers is associated with an award of 10 credits, a quantity of four matching numbers is associated with an award of 10 credits, a quantity of five matching numbers is associated with an award of 20 credits, a quantity of six matching numbers is associated with an award of 350 credits, a quantity of seven matching numbers is associated with an award of 1,150 credits, a quantity of eight matching numbers is associated with an award of 2,750 credits, a quantity of nine matching numbers is associated with an award of 3,500 credits, and a quantity of ten matching numbers is associated with an award of 4,000 credits.

Figure 2A:
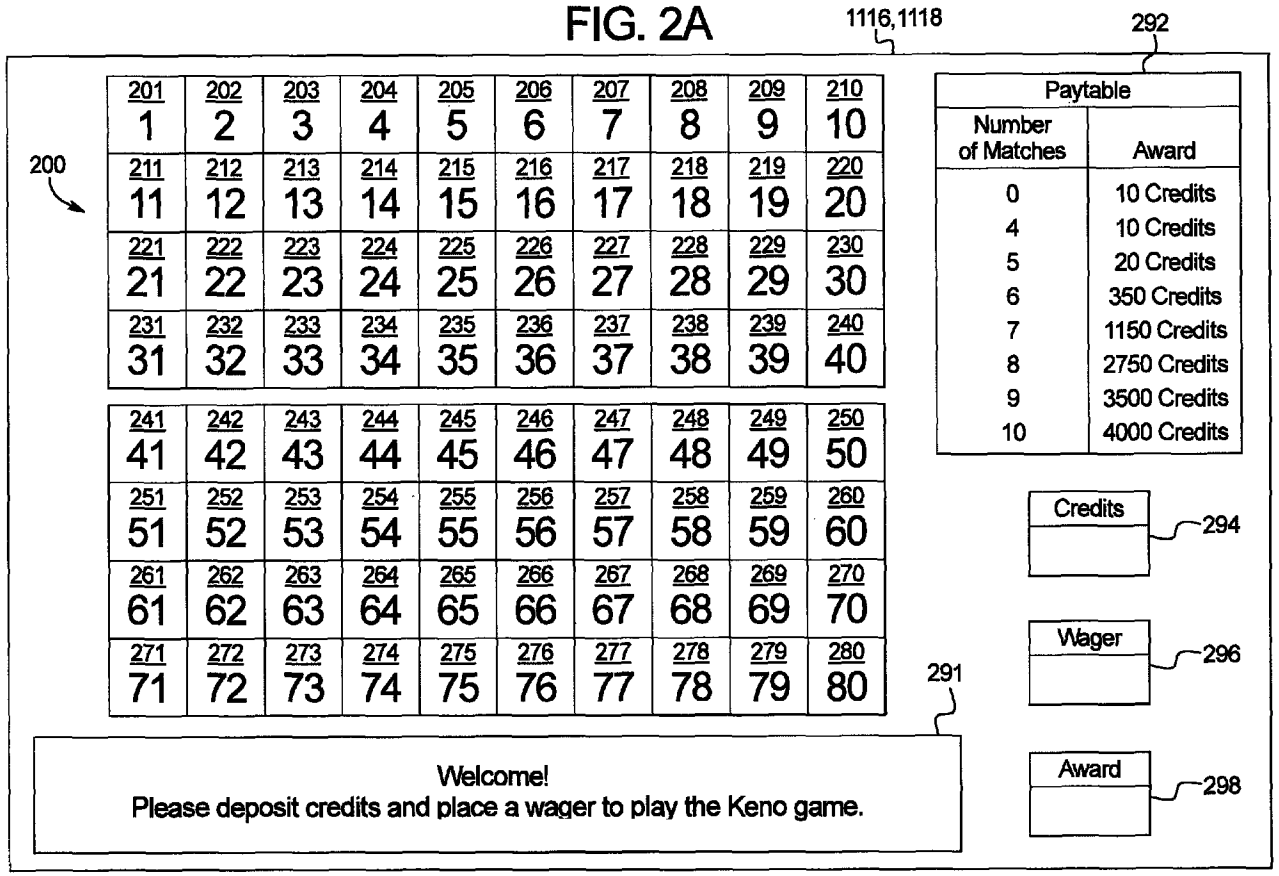
FIGS. 2A, 2B, 2C, 2D, and 2E illustrate screen shots of an example embodiment of the gaming system of the present disclosure configured to operate a keno game in which a selection of a designated number to form the gaming system number set causes the gaming system to add a plurality of additional numbers to the gaming system number set based on a predetermined pattern to form a modified gaming system number set.

As illustrated in FIG. 2A, in this example, when the gaming system is not being played, the gaming system displays the following message in message display area 291: "Welcome! Please deposit credits and place a wager to play the keno game." That is, the gaming system displays a message inviting a player to deposit value (e.g., insert currency or a redeemable ticket having a cash value into a payment acceptor of the gaming system, as further described below) to fund the gaming system and to place a wager using that deposited value to play the keno game.

Figure 2B:
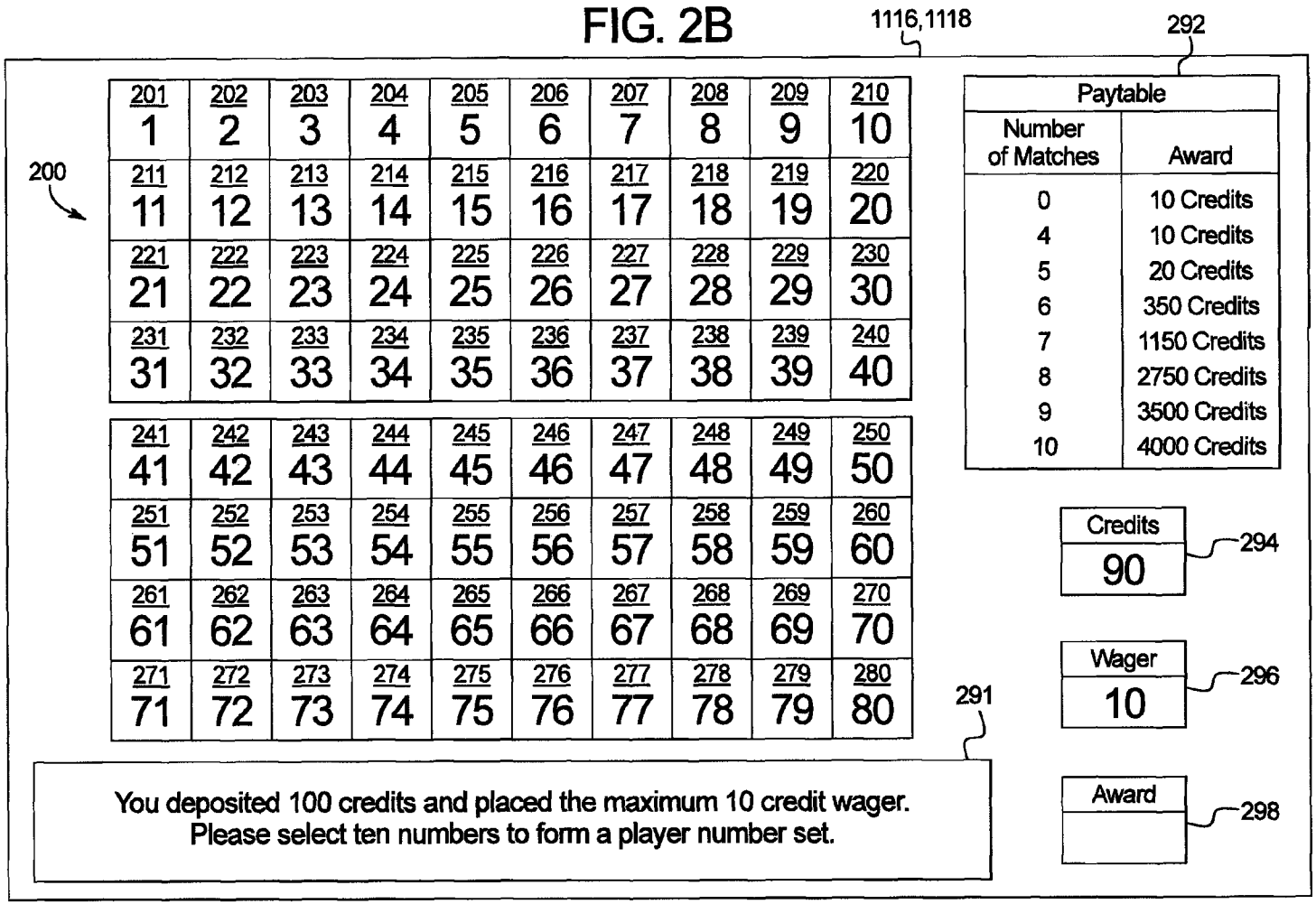

As illustrated in FIG. 2B, a player funded the gaming system by depositing value. The gaming system provided the player with 100 credits, which represent the deposited value in this example. The player subsequently placed the maximum wager of 10 credits to initiate a play of the keno game. The gaming system displayed the player's wager of 10 credits in wager indicator 296. The gaming system displayed the player's total remaining credit balance of 90 credits (i.e., the player's initial credit balance of 100 credits minus the player's wager of 10 credits) in credit meter 294. In this example, as noted above, upon initiation of a play of the keno game, the gaming system randomly selects one of the numbers as the designated number. In this illustrated example, though not shown, upon initiation of the play of the keno game the gaming system randomly selected the number 57 as the designated number. The gaming system displayed the following message in message display area 211: "You deposited 100 credits and placed the maximum 10 credit wager. Please select ten numbers to form a player number set."

Figure 2C:
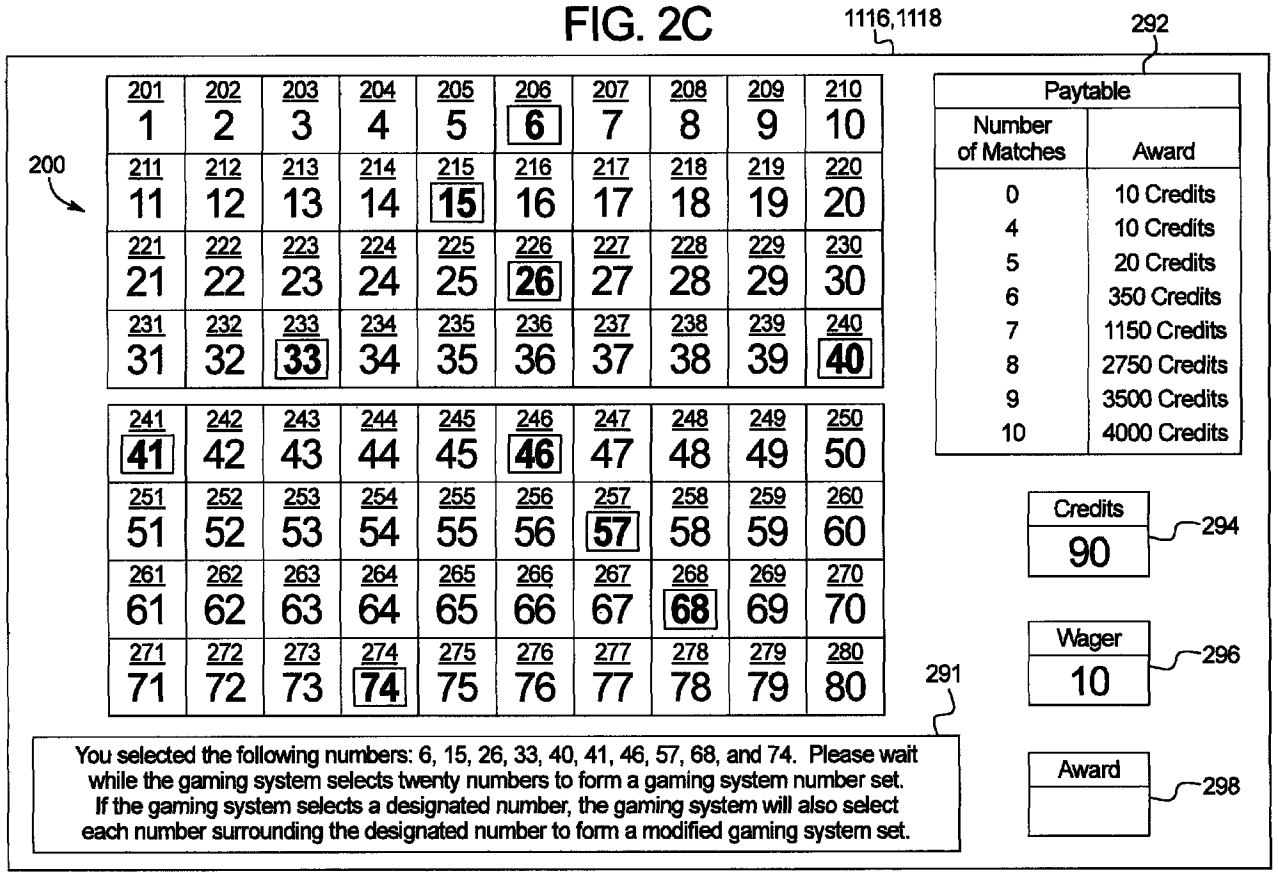

In this example, upon initiation of the play of the keno game, the gaming system enables the player to select ten of the numbers (such as by using a touch screen or a dedicated button or buttons, as described further below). In this illustrated example, as illustrated in FIG. 2C, the gaming system received a selection of the following ten numbers to form the player number set: 6, 15, 26, 33, 40, 41, 46, 57, 68, and 74. The numbers forming the player number set are each bolded and boxed for clarity in FIGS. 2C, 2D, and 2E. The gaming system displayed the following message in message display area 291: "You selected the following numbers: 6, 15, 26, 33, 40, 41, 46, 57, 68, and 74. Please wait while the gaming system selects twenty numbers to form a gaming system number set. If the gaming system selects a designated number, the gaming system will also select each number surrounding the designated number to form a modified gaming system number set."

Figure 2D:
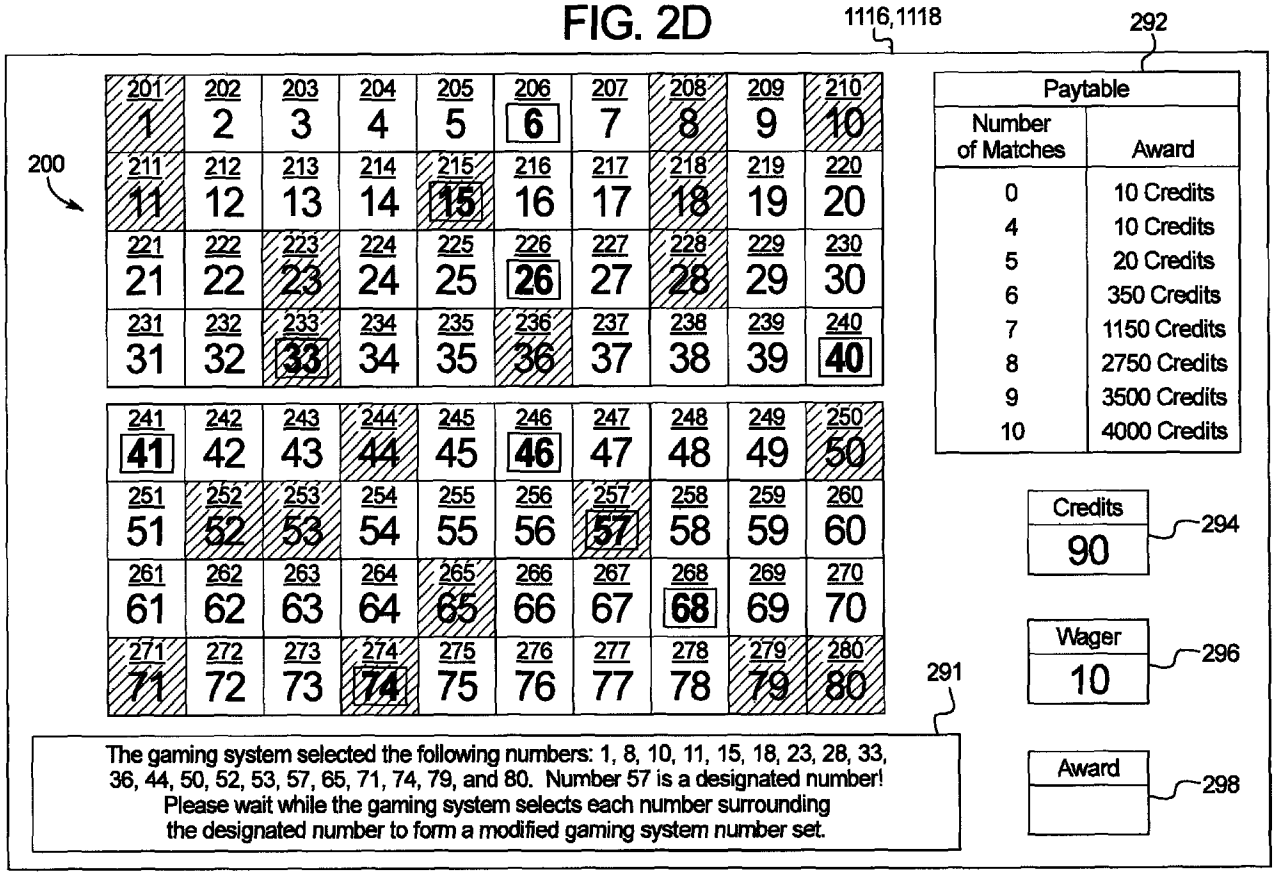

As illustrated in FIG. 2D, the gaming system randomly selected the following twenty numbers to form the gaming system number set: 1, 8, 10, 11, 15, 18, 23, 28, 33, 36, 44, 50, 52, 53, 57, 65, 71, 74, 79, and 80. The numbers forming the gaming system number set are hashed for clarity in FIGS. 2D and 2E. In this example, as generally described above, after the gaming system randomly selects the numbers to form the gaming system number set, the gaming system determines whether the additional number triggering event occurred. Here, the additional number triggering event occurs when the gaming system randomly selects the designated number, which is the number 57 in this example, to form the gaming system number set. In this example, the gaming system determined that the additional number triggering event occurred because the gaming system selected the designated number (i.e., the number 57) to form the gaming system number set. The gaming system displayed the following message in message display area 291: "The gaming system selected the following numbers: 1, 8, 10, 11, 15, 18, 23, 28, 33, 36, 44, 50, 52, 53, 57, 65, 71, 74, 79, and 80. Number 57 is a designated number! Please wait while the gaming system selects each number surrounding the designated number to form a modified gaming system number set."

Figure 2E:
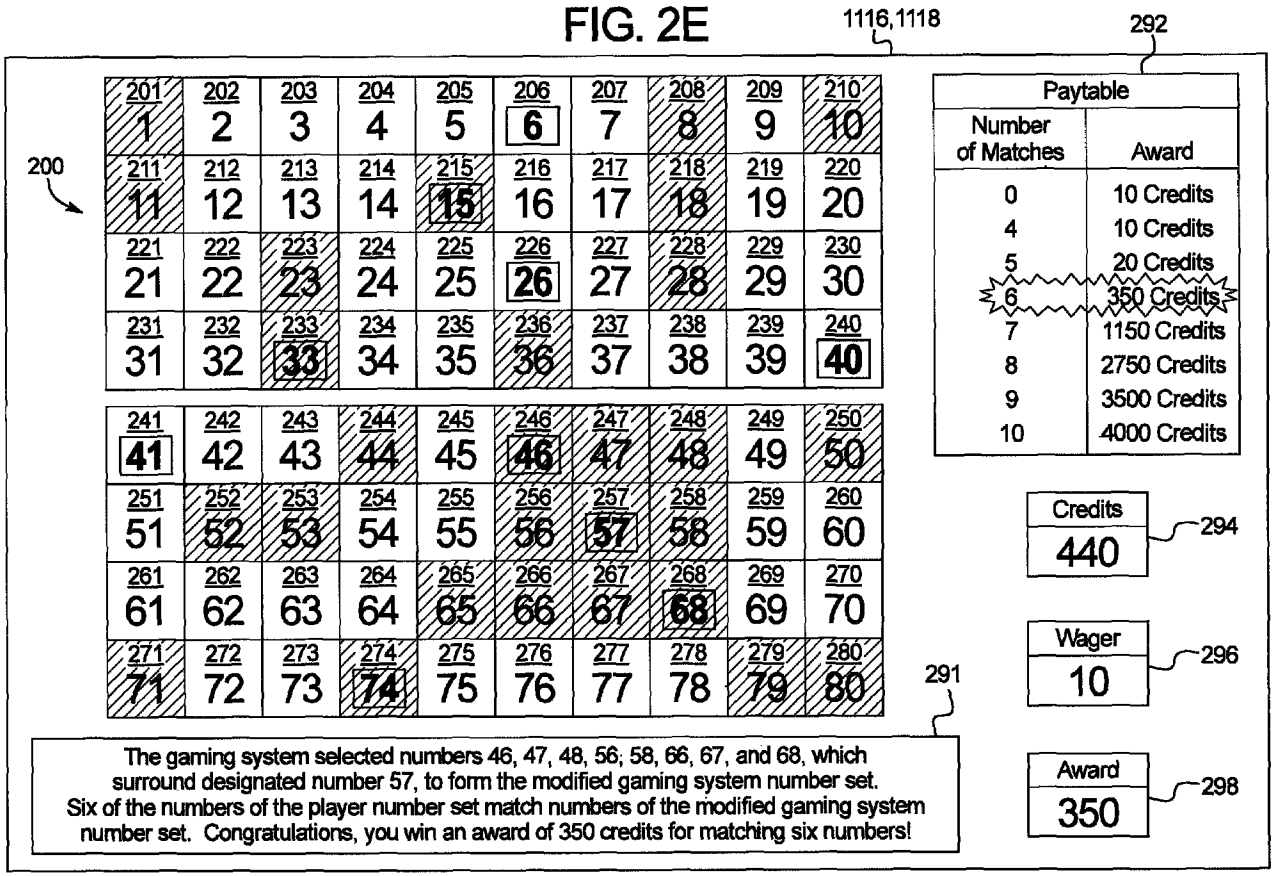

As illustrated in FIG. 2E, in this example the gaming system added each number immediately surrounding the designated number, which are the numbers 46, 47, 48, 56, 58, 66, 67, and 68, to the gaming system number set to form the modified gaming system number set. In this example, the gaming system determines any awards by comparing the player number set with the modified gaming system number set to determine a quantity of matching numbers. In this illustrated example, the player number set and the modified gaming system number set each include the following numbers: 15, 33, 46, 57, 68, and 74. Thus, the quantity of matching numbers for this play of the keno game is equal to six. The gaming system determined an award of 350 credits according to paytable 292, and provided the 350 credit award to the player. The gaming system displayed the 350 credit award in award indicator 298 and displayed the player's updated credit balance of 440 credits (i.e., the player's previous credit balance of 90 credits plus the 350 credit award).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
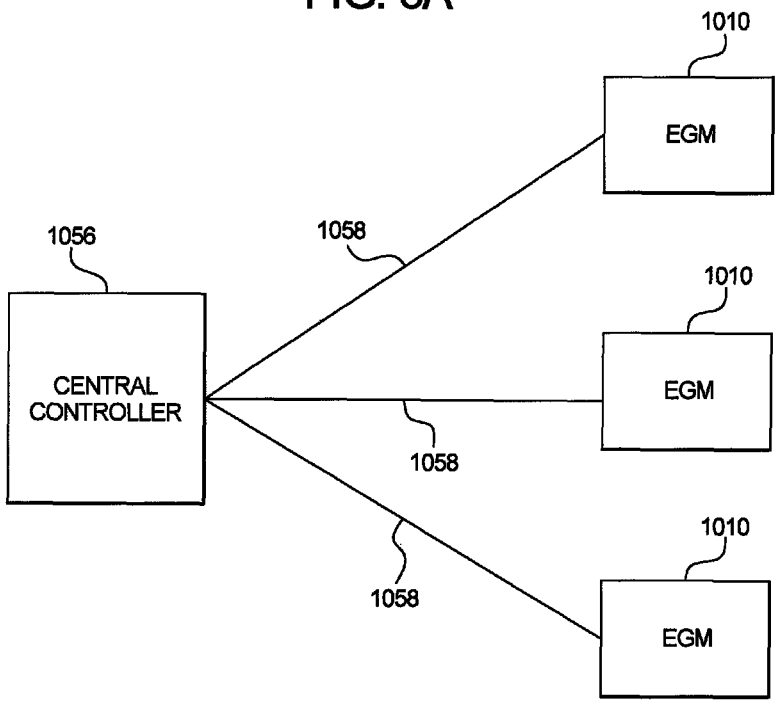
FIG. 3A is a schematic block diagram of an example network configuration of one embodiment of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
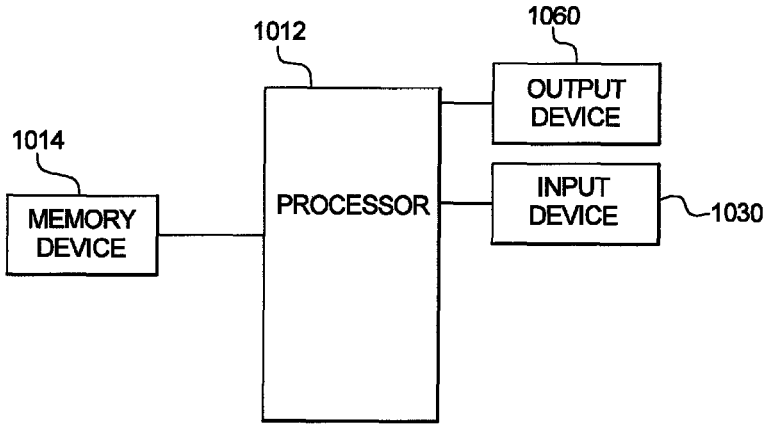
FIG. 3B is a schematic block diagram of an example electronic configuration of a gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
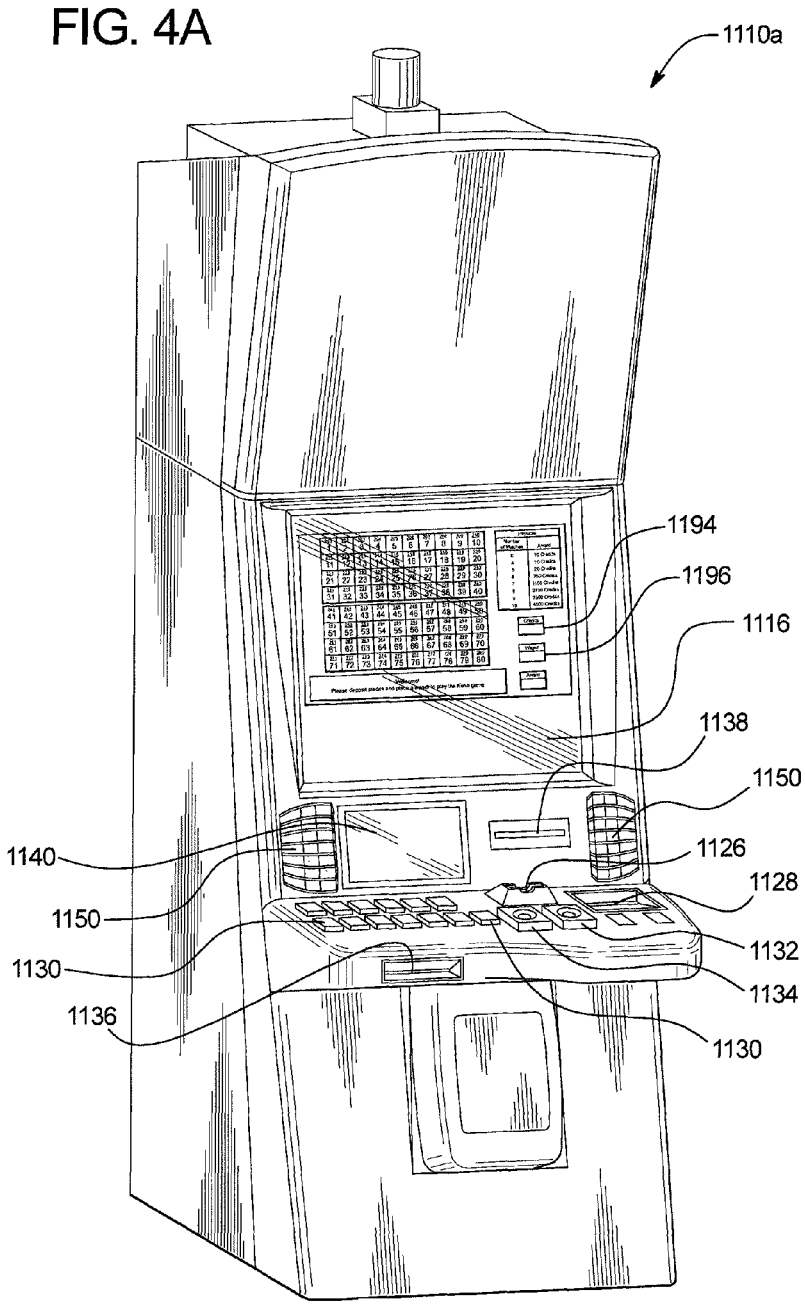
FIGS. 4A and 4B are perspective views of example alternative embodiments of gaming systems of the present disclosure.
Figure 4B:
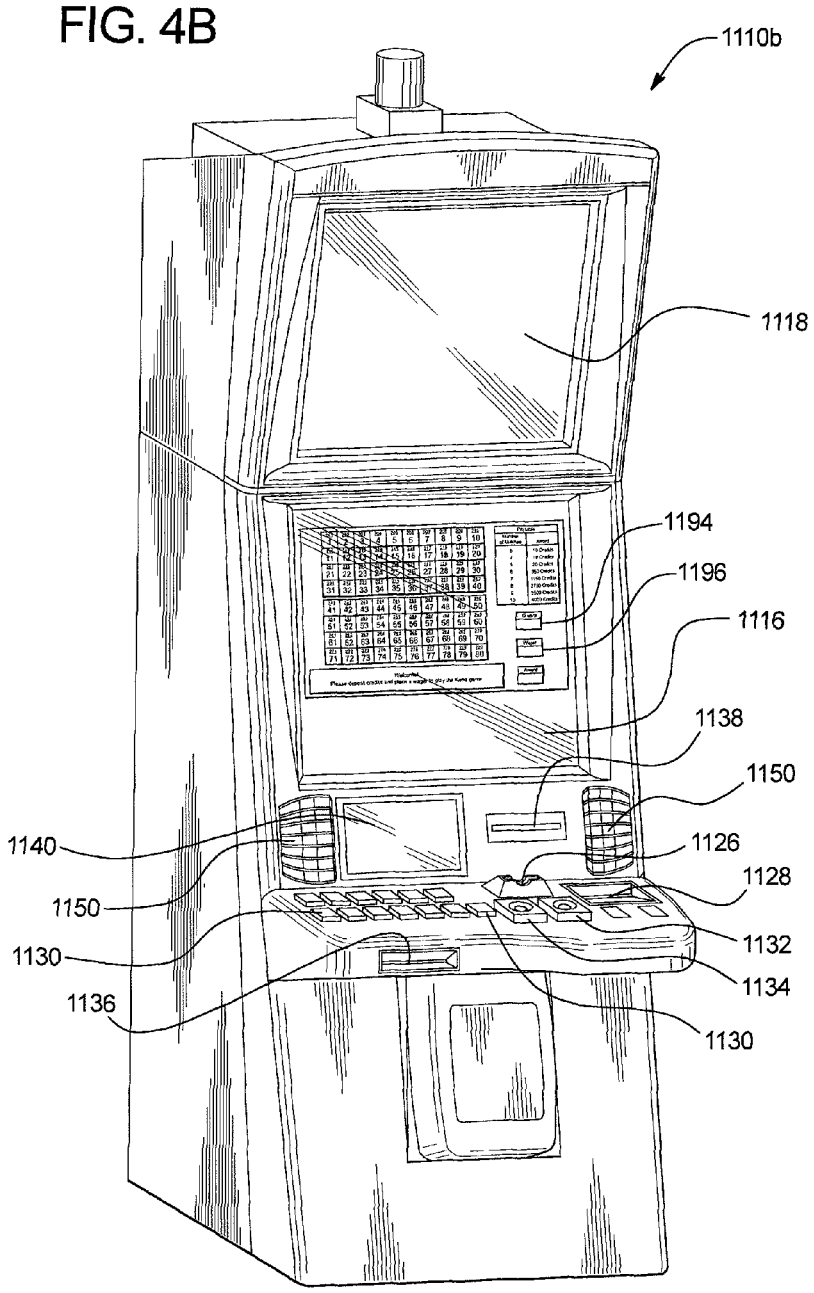

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1194, and a bet display 1196. The example EGM illustrated in FIG. 4B includes a central display device 1116, an upper display device 1118, a player tracking display 1140, a player tracking display 1140, a credit display 1194, and a bet display 1196.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games, such as the keno game of the present disclosure (in certain embodiments), and one or more secondary games, such as the keno game of the present disclosure (in other embodiments). In various embodiments, the primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the secondary game (such as when the keno game of the present disclosure is the primary game) or the primary game (such as when the keno game of the present disclosure is the secondary game) is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In certain such embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor;

at least one display device;

at least one input device; and at least one memory device storing a plurality of instructions which, when executed by the at least one processor, cause the at least one processor to operate with the at least one display device and the at least one input device to, for a play of a keno game:

(a) display a plurality of different numbers;

(b) receive a selection from a player of at least one of the numbers to form a player number set;

(c) randomly select a designated quantity of the numbers to form a gaming system number set;

(d) upon an occurrence of an additional number triggering event:

(i) determine at least one of the numbers based on a proximity of at least one of the displayed numbers to one of the displayed selected numbers, wherein a probability of determining a first number within a first proximity of said one of the displayed selected numbers is different from a probability of determining a second different number within a second different proximity of said one of the displayed selected numbers; and (ii) add the determined at least one of the numbers to one of:

(A) the gaming system number set to form a modified gaming system number set, and (B) the player number set to form a modified player number set;

(e) if the determined at least one of the numbers was added to the gaming system number set to form the modified gaming system number set, determine any awards based on a comparison of the player number set with the modified gaming system number set;

(f) if the determined at least one of the numbers was added to the player number set to form the modified player number set, determine any awards based on a comparison of the modified player number set with the gaming system number set; and (g) provide any determined awards.

2. The gaming system of claim 1, wherein the numbers include one or more designated numbers.

3. The gaming system of claim 2, wherein the additional number triggering event occurs when one of the designated numbers is selected to form the player number set, and wherein the plurality of instructions, when executed by the at least one processor, cause the at least one processor to, upon the occurrence of the additional number triggering event, add the determined at least one of the numbers to the player number set to form the modified player number set.

4. The gaming system of claim 2, wherein the additional number triggering event occurs when one of the designated numbers is selected to form the gaming system number set, and wherein the plurality of instructions, when executed by the at least one processor, cause the at least one processor to, upon the occurrence of the additional number triggering event, add the determined at least one of the numbers to the gaming system number set to form the modified gaming system number set.

5. The gaming system of claim 2, wherein the plurality of instructions, when executed by the at least one processor, cause the at least one processor to repeat (d)(i) to (d)(ii) if one of the designated numbers is added to one of:

(i) the gaming system number set to form the modified gaming system number set, and (ii) the player number set to form the modified player number set.

6. The gaming system of claim 1, wherein the plurality of instructions, when executed by the at least one processor, cause the at least one processor to, upon the occurrence of the additional number triggering event, randomly determine a quantity of the numbers to add to one of: (i) the gaming system number set to form the modified gaming system number set, and (ii) the player number set to form the modified player number set.

7. The gaming system of claim 1, wherein the player number set includes a plurality of the numbers.

8. A method of operating a gaming system, said method comprising:

for a play of a keno game:

(a) causing at least one processor to execute a plurality of instructions stored in at least one memory device to operate with at least one display device to display a plurality of different numbers;

(b) receiving a selection from a player of at least one of the numbers to form a player number set;

(c) causing the at least one processor to execute the plurality of instructions to randomly select a designated quantity of the numbers to form a gaming system number set;

(d) upon an occurrence of an additional number triggering event, causing the at least one processor to execute the plurality of instructions to:

(i) determine at least one of the numbers based on a proximity of at least one of the displayed numbers to one of the displayed selected numbers, wherein a probability of determining a first number within a first proximity of said one of the displayed selected numbers is different from a probability of determining a second different number within a second different proximity of said one of the displayed selected numbers; and (ii) add the determined at least one of the numbers to one of:

(A) the gaming system number set to form a modified gaming system number set, and (B) the player number set to form a modified player number set;

(e) if the determined at least one of the numbers was added to the gaming system number set to form the modified gaming system number set, causing the at least one processor to execute the plurality of instructions to determine any awards based on a comparison of the player number set with the modified gaming system number set;

(f) if the determined at least one of the numbers was added to the player number set to form the modified player number set, causing the at least one processor to execute the plurality of instructions to determine any awards based on a comparison of the modified player number set with the gaming system number set; and (g) providing any determined awards.

9. The method of claim 8, wherein the numbers include one or more designated numbers.

10. The method of claim 9, wherein the additional number triggering event occurs when one of the designated numbers is selected to form the player number set, and which includes causing the at least one processor to execute the plurality of instructions to, upon the occurrence of the additional number triggering event, add the determined at least one of the numbers to the player number set to form the modified player number set.

11. The method of claim 9, wherein the additional number triggering event occurs when one of the designated numbers is selected to form the gaming system number set, and which includes causing the at least one processor to execute the plurality of instructions to, upon the occurrence of the additional number triggering event, add the determined at least one of the numbers to the gaming system number set to form the modified gaming system number set.

12. The method of claim 9, which includes repeating (d)(i) to (d)(ii) if one of the designated numbers is added to one of: (i) the gaming system number set to form the modified gaming system number set, and (ii) the player number set to form the modified player number set.

13. The method of claim 11, which includes causing the at least one processor to execute the plurality of instructions to, upon the occurrence of the additional number triggering event, randomly determine a quantity of the numbers to add to one of: (i) the gaming system number set to form the modified gaming system number set, and (ii) the player number set to form the modified player number set.

14. The method of claim 8, wherein the player number set includes a plurality of the numbers.

15. The method of claim 8, which is provided through a data network.

16. The method of claim 15, wherein the data network is an internet.

17. A non-transitory computer readable medium storing a plurality of instructions which, when executed by at least one processor, cause the at least one processor to:

for a play of a keno game:

(a) cause at least one display device to display a plurality of different numbers;

(b) receive a selection from a player of at least one of the numbers to form a player number set;

(c) randomly select a designated quantity of the numbers to form a gaming system number set;

(d) upon an occurrence of an additional number triggering event:

(i) determine at least one of the numbers based on a proximity of at least one of the displayed numbers to one of the displayed numbers wherein a probability of determining a first number within a first proximity of said one of the displayed selected numbers is different from a probability of determining a second different number within a second different proximity of said one of the displayed selected numbers; and (ii) add the determined at least one of the numbers to one of:

(A) the gaming system number set to form a modified gaming system number set, and (B) the player number set to form a modified player number set;

(e) if the determined at least one of the numbers was added to the gaming system number set to form the modified gaming system number set, determine any awards based on a comparison of the player number set with the modified gaming system number set;

(f) if the determined at least one of the numbers was added to the player number set to form the modified player number set, determine any awards based on a comparison of the modified player number set with the gaming system number set; and (g) provide any determined awards.

18. The non-transitory computer readable medium of claim 17, wherein the numbers include one or more designated numbers.

19. The non-transitory computer readable medium of claim 18, wherein the additional number triggering event occurs when one of the designated numbers is selected to form the player number set, and wherein the plurality of instructions, when executed by the at least one processor, cause the at least one processor to, upon the occurrence of the additional number triggering event, add the determined at least one of the numbers to the player number set to form the modified player number set.

20. The non-transitory computer readable medium of claim 18, wherein the additional number triggering event occurs when one of the designated numbers is selected to form the gaming system number set, and wherein the plurality of instructions, when executed by the at least one processor, cause the at least one processor to, upon the occurrence of the additional number triggering event, add the determined at least one of the numbers to the gaming system number set to form the modified gaming system number set.

21. The non-transitory computer readable medium of claim 18, wherein the plurality of instructions, when executed by the at least one processor, cause the at least one processor to repeat (d)(i) to (d)(ii) if one of the designated numbers is added to one of: (i) the gaming system number set to form the modified gaming system number set, and (ii) the player number set to form the modified player number set.

22. The non-transitory computer readable medium of claim 17, wherein the plurality of instructions, when executed by the at least one processor, cause the at least one processor to, upon the occurrence of the additional number triggering event, randomly determine a quantity of the numbers to add to one of: (i) the gaming system number set to form the modified gaming system number set, and (ii) the player number set to form the modified player number set.

23. The non-transitory computer readable medium of claim 17, wherein the player number set includes a plurality of the numbers.

* * * * *